US005177499A

United States Patent [19]

Yoshida et al.

[11] Patent Number: 5,177,499

[45] Date of Patent: Jan. 5, 1993

[54] RECORDING APPARATUS WITH MEANS FOR PREHEATING

[75] Inventors: Takehiro Yoshida, Tokyo; Makoto Kobayashi, Tama; Satoshi Wada, Kawasaki; Tomoyuki Takeda; Takeshi Ono, both of Yokohama; Yasushi Ishida, Tokyo; Minoru Yokoyama, Yokohama; Akihiro Tomoda, Yokohama; Masakatsu Yamada, Yokohama; Takashi Awai, Yokohama, all of Japan

[73] Assignee: Canon Kabushiki Kaisha, Tokyo, Japan

[21] Appl. No.: 558,486

[22] Filed: Jul. 27, 1990

[30] Foreign Application Priority Data

Jul. 28. 1989 [JP] Japan ..... 1-194214

[51] Int. Cl.[5] ..... B41J 2/38

[52] U.S. Cl. ..... 346/76 PH

[58] Field of Search ..... 346/76 PH; 400/120

[56] References Cited

U.S. PATENT DOCUMENTS 4,456,392 6/1984 Nozaki et al. ..... 400/120
4,875,056 10/1989 Ono ..... 346/76 PH
4,912,485 3/1990 Minowa ..... 346/76 PH
4,963,884 10/1990 Kiguchi et al. ..... 346/76 PH

FOREIGN PATENT DOCUMENTS 0201686 11/1983 Japan .
0211473 12/1983 Japan ..... 346/76 PH
0095177 6/1984 Japan .
0003969 1/1987 Japan .
165169 7/1988 Japan ..... 346/76 PH
2204280 11/1988 United Kingdom ..... 346/76 PH

*Primary Examiner*—Benjamin R. Fuller
*Assistant Examiner*—N. Le
*Attorney, Agent, or Firm*—Fitzpatrick, Cella, Harper & Scinto

[57] ABSTRACT

A heat transfer recording apparatus of the present invention reliably separates an ink sheet and recording paper which have been joined at recording of immediately before from each other when ink of the ink sheet is transferred to recording paper to record an image. More concretely, when an ink sheet and recording paper are transported to record an image of a noticed line, a recording head is heated on the basis of the image data of the line recorded immediately before. As a result, the ink of the ink sheet is melted and therefore the sheet and the recording paper can be separated easily.

19 Claims, 11 Drawing Sheets

RECORDING APPARATUS WITH MEANS FOR PREHEATING

BACKGROUND OF THE INVENTION

1. Field of the Invention

The present invention relates to a heat transfer recording apparatus which transfers ink from an ink sheet to a recording medium in order to record images on the recording medium and to a facsimile using the same.

2. Description of the Related Art

In heat transfer printers, generally, an ink sheet with a heat meltable (heat sublimable) ink applied on a base film is used. Heat transfer printers record images in such a way that the ink sheet is selectively heated by a thermal head in response to an image signal and the molten (sublimed) ink is transferred to recording paper. Since this ink sheet is usually the type in which ink is completely transferred onto recording paper after one image recording (a so-called one-time sheet), after one character or one line is recorded, the ink sheet must be conveyor by a distance corresponding to the length of the recording so as to reliably bring an unused portion of the ink sheet to a position at which recording will be made next. As a result, the amount of ink sheet used is increased, and the running cost of heat transfer printers is likely to be higher than that of thermal printers which print on thermal paper.

To solve such problems, a heat transfer printer in which the transport speed of recording paper is made to differ from that of an ink sheet has been proposed, as disclosed in Japanese Patent Laid-Open Nos. 57-83471, 58-201686, and 62-58917.

There is a known ink sheet (the so-called multiprint sheet) with which plural (n times) image recording operations are possible. The use of this ink sheet enables recording in the state in which the transport length of an ink sheet transported after image recording for each line or during image recording is made smaller than a length L (L/n: $n>1$) when recording is continuously made at the recording length L. Therefore, the efficiency of the use of ink sheets is increased by a factor of n over the previous efficiency and the running cost of heat transfer printers can be expected to be lowered. Hereinafter, this recording method is called the multiprint recording method.

When an ink sheet is used with the multiprint method, the ink of the ink layer of the ink sheet is divided into n parts and heated n times. A shearing force is generated, during each of these heating operations, between the molten (sublimed) ink of the ink layer and the ink which has not been melted (sublimed), and transfer is performed on recording paper. For this reason, for example, if the ink cools because the time between recording of the next line after the recording for one line becomes long, a problem arises in that a shearing force between the molten (sublimed) ink of the ink layer and the ink which has not been molten (sublimed) becomes larger and the ink sheet is difficult to separate from the recording paper. This problem becomes conspicuous when one line of record data contains black data. This also becomes a problem in an apparatus like a facsimile, in which the interval of recording time between the current line and the next line is not fixed and the overall intervals of recording times are relatively longer.

SUMMARY OF THE INVENTION

The present invention has been devised in view of the above-mentioned circumstances. Accordingly, an object of the present invention is to provide a heat transfer recording apparatus which is capable of recording high-quality images in which an ink sheet is separated from a recording medium after each recording operation.

In order to achieve the above-mentioned object, the heat transfer recording apparatus of the present invention which records images on the above-mentioned recording medium by transferring ink contained in an ink sheet to the recording medium comprises an ink sheet transport means for transporting the ink sheet, a recording medium transport means for transporting the recording medium, a recording means for recording images on the recording medium by working on the ink sheet, a judgment means for judging whether or not image data to be recorded next is ready for recording, a first heating control means for controlling the heating of the recording means when the judgment means has judged that an image to be recorded next is being prepared, a second heating control means for controlling the heating of the recording means immediately before the image data to be recorded next is recorded when more than a predetermined time is required before an image to be recorded next is prepared, and a control means for controlling the driving of the ink sheet transport means and the recording medium transport means so as to transport the ink sheet and the recording medium to record the next image when the judgment means has judged that the preparation of the image data to be recorded next is completed and the first and second heating control means have heated the recording means.

Another object of the present invention is to provide a heat transfer recording apparatus that in turn records images on a recording medium line by line, in which recording paper is easily separated from an ink sheet at any time and which is capable of recording excellent images even if the time required before an image of the next line to be recorded is prepared varies.

To achieve this object, the heat transfer recording apparatus that records images by transferring the ink of an ink sheet to a recording medium on the basis of image data for one line prepared in turn comprises an ink sheet transport means for transporting the ink sheet, a recording medium transport means for transporting the recording medium, a recording means having heat producing resistor elements needed for the recording of one line, for recording images by making the heat producing resistor elements produce heat which correspond to the image data, a judgment means for judging whether or not image data to be recorded from the next line is prepared after one line of image is recorded by the recording means, a first heating control means for controlling the heating of the recording means when the judgment means has judged that an image to be recorded from the next line is being prepared, a second heating control means for controlling the heating of the recording means immediately before recording on the basis of the image data to be recorded from the next line is performed when more than a predetermined time is required before the image data to be recorded from the next line is prepared, and a control means for controlling the driving of the ink sheet transport means and the recording medium transport means so as to transport the ink sheet and the recording medium in order to record the next image when the judgment means has judged that the preparation of the image data to be recorded next is completed and the first and second heating control means have heated the recording means.

The heat transfer recording apparatus of the present invention that records images on the recording medium by transferring the ink contained in the ink sheet to the recording medium comprises an ink sheet transport means for transporting the ink sheet, a recording medium transport means for transporting the recording medium, a recording means having heat producing resistor elements needed for the recording of one line, and a heating control means for heating the recording means on the basis of one line of image data recorded immediately before, before the ink sheet transport means and the recording medium transport means are driven to transport a predetermined amount in order to perform image recording on the basis of the record images of a noticed line.

Another object of the present invention is to provide a facsimile apparatus that records images on a recording medium line by line by decoding received data, in which recording paper is easily separated from an ink sheet at any time and which is capable of recording excellent images even if the time required before an image of the next line to be recorded is prepared varies.

To achieve this object, a facsimile apparatus of the present invention, in which a heat transfer recording apparatus is used, that records images by decoding data received via a line comprises a decoding means for decoding data received via a line, an ink sheet transport means for transporting ink sheets, a recording medium transport means for transporting a recording medium onto which the ink sheet is to be transferred, a recording medium for recording images on the recording medium by working on the ink sheet on the basis of one line of image data to be recorded obtained by decoding by means of the decoding means, a judgment means for judging whether or not one line of images to be recorded next are being decoded by means of the decoding means and images to be recorded are being prepared after one line of images are recorded by the recording means, a first heating control means for controlling the heating of the recording means when the judgment means has judged that image data to be recorded from the next line is being prepared, a second heating control means for controlling the heating of the recording means immediately before the operation for recording images from the next line when more than a predetermined time is required before the preparation of the image data to be recorded from the next line is completed, and a control means for controlling the driving of the ink sheet transport means and the recording medium transport means so as to transport the ink sheet and the recording medium for the recording of the image to be recorded from the next line when the judgment means has judged that the preparation of the image data to be recorded next is completed and the first and second heating control means have heated the recording means.

A facsimile apparatus of the present invention, in which a heat transfer recording apparatus is used, that records images by decoding data received via a line comprises a decoding means for decoding data received via a line, an ink sheet transport means for transporting ink sheets, a recording medium transport means for transporting a recording medium onto which the ink sheet is to be transferred, a recording means having heat producing resistance elements needed for the recording of one line, for recording images by making the heat producing resistor produce heat on the basis of one line of image data obtained by decoding by means of the decoding means, and a heating control means for heating the recording means on the basis of one line of image data recorded immediately before, before the ink sheet transport means and the recording medium transport means are driven to transport a predetermined amount in order to perform image recording on the basis of the images of a noticed line to be recorded.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

The embodiments of the present invention will be explained in detail hereinunder with reference to the accompanying drawings.

Figure 1:
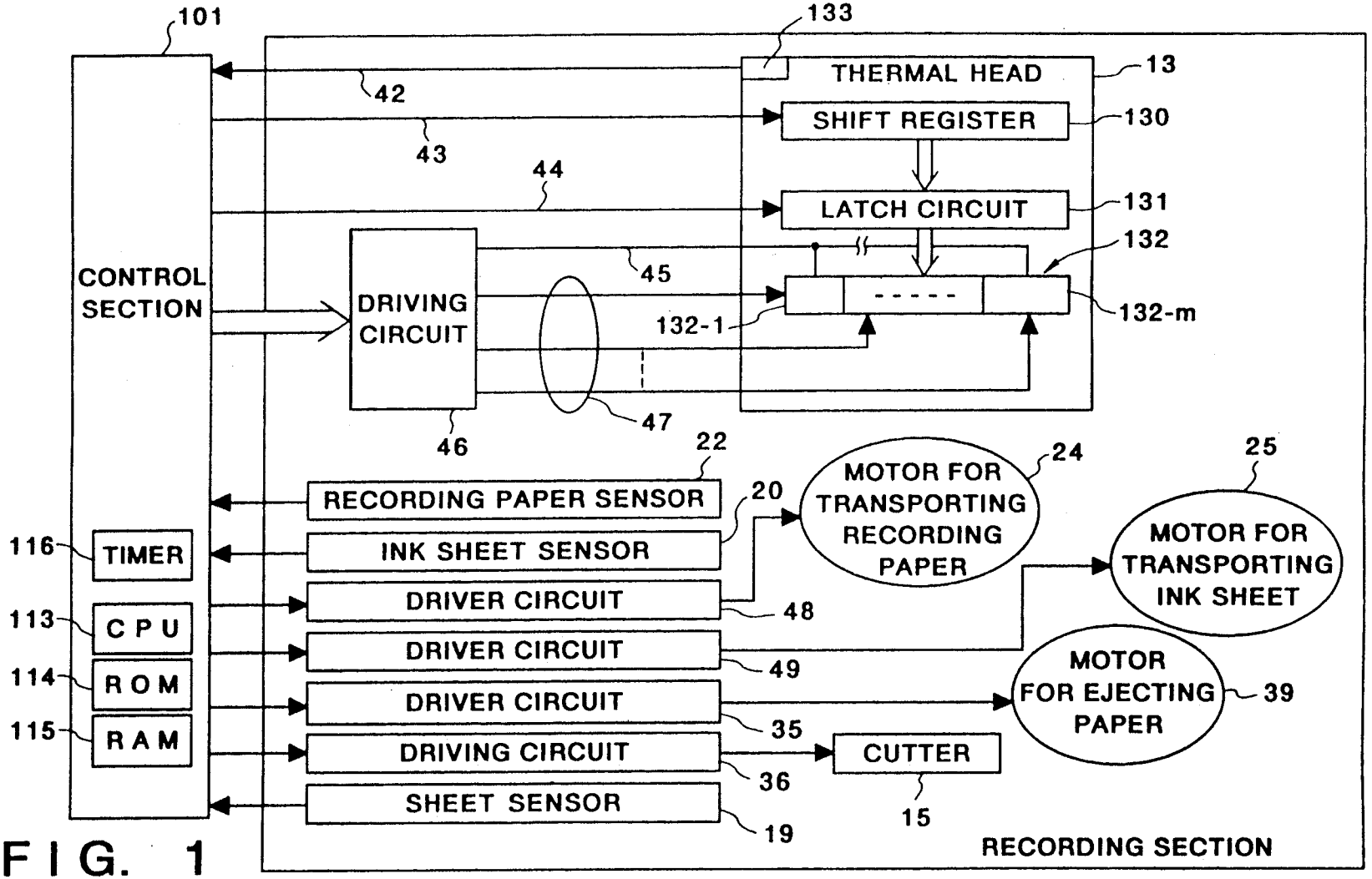
FIG. 1 is a view illustrating electrical connections between a control section and a recording section of a facsimile apparatus according to an embodiment.
Figure 2:
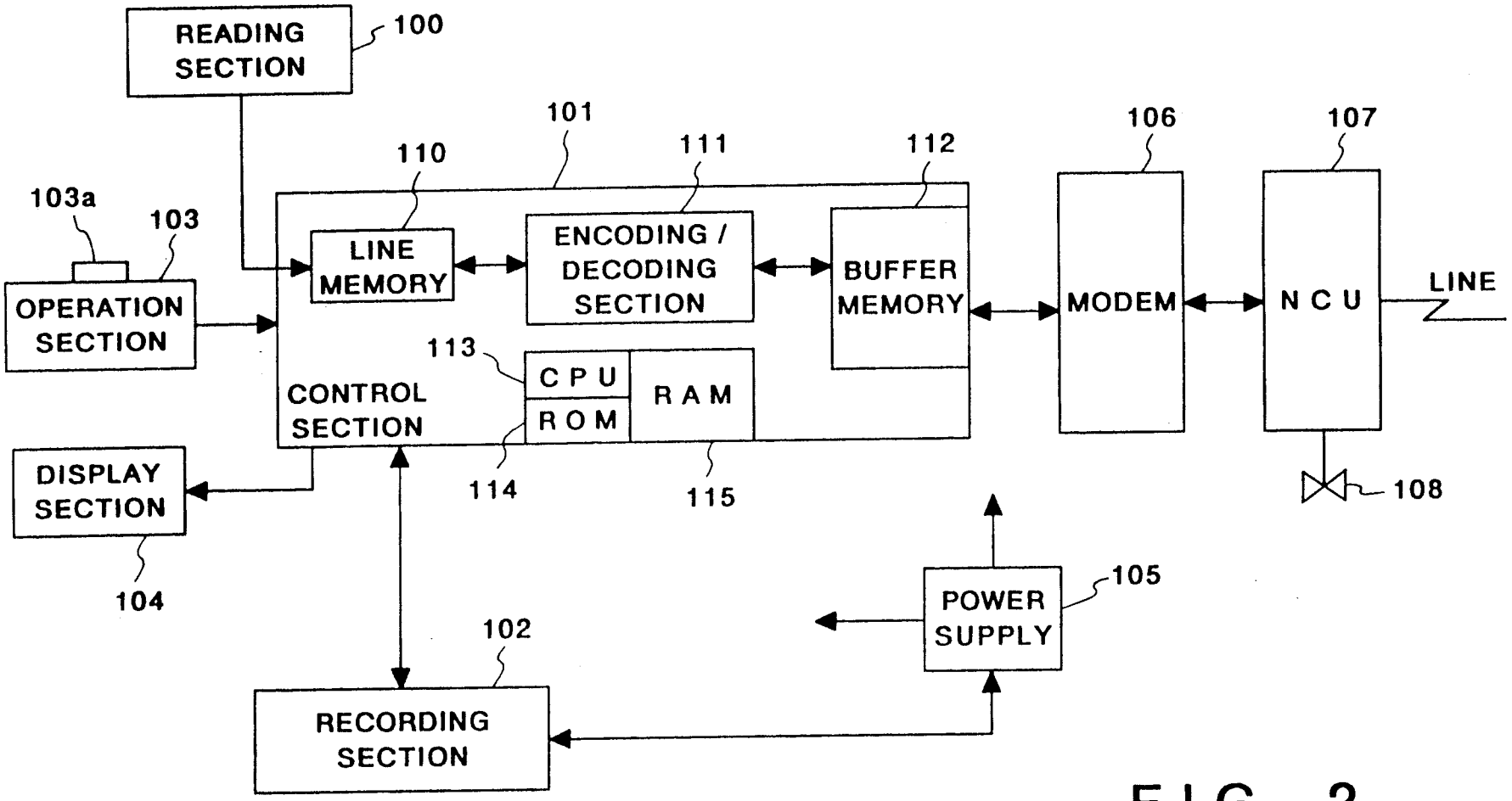
FIG. 2 is a block diagram showing the schematic construction of the facsimile apparatus according to the embodiment.
Figure 3:
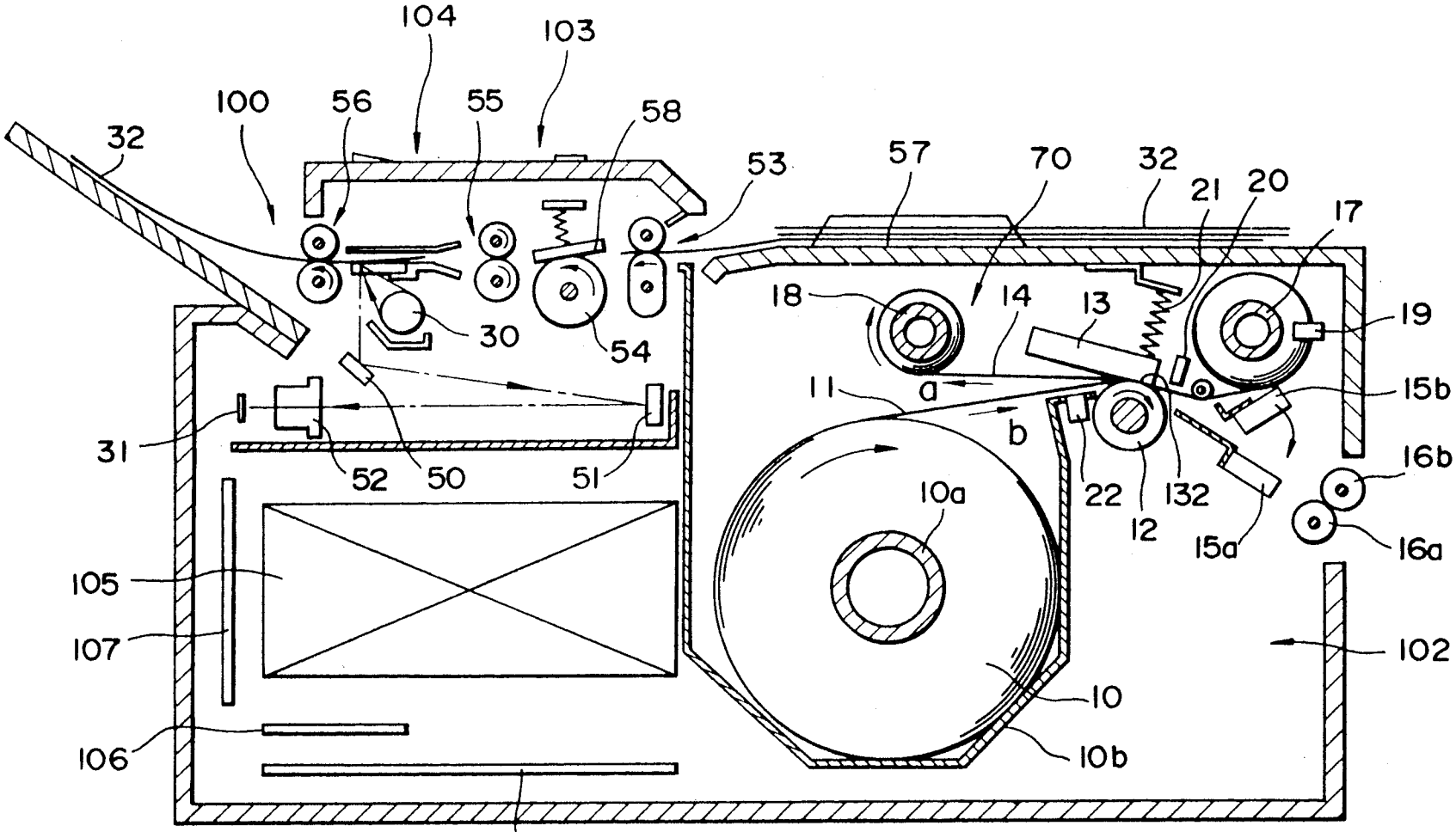
FIG. 3 is a side cross-sectional view of the facsimile apparatus according to the embodiment.
Figure 4:
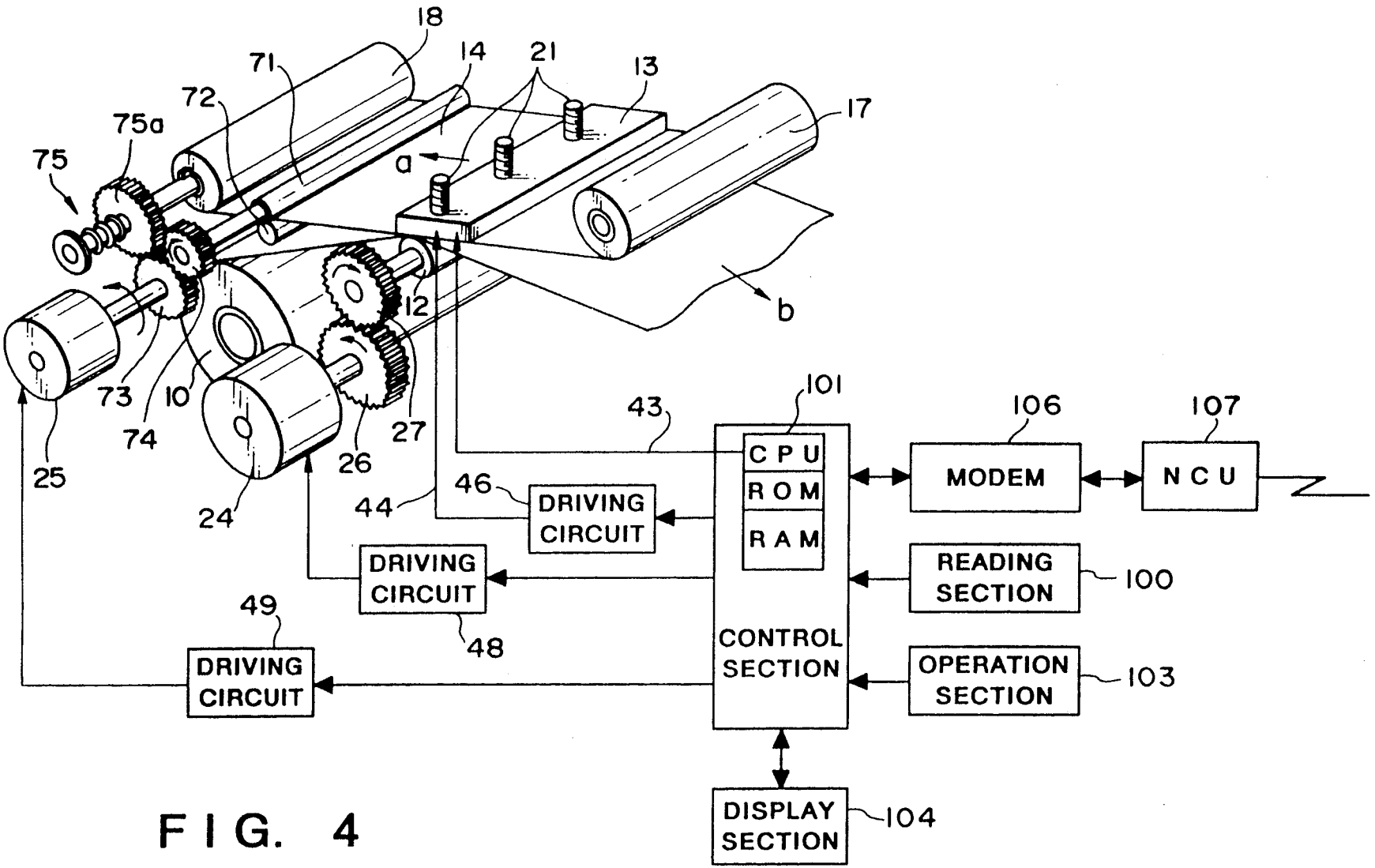
FIG. 4 is a view illustrating the relationship between the ink sheet and recording paper transport section and the control section.

FIGS. 1 to 4 show examples in which a heat transfer printer according to an embodiment of the present invention is used for a facsimile apparatus. FIG. 1 is a view illustrating the electrical connections between a control section 101 and a recording section 102 of a facsimile apparatus according to an embodiment. FIG. 2 is a block diagram showing the schematic construction of the facsimile apparatus. FIG. 3 is a side cross-sectional view of the facsimile apparatus. FIG. 4 is a view illustrating the relationship between the ink sheet and recording paper transport section and the control section 101.

First, the schematic construction of the facsimile apparatus will be explained with reference to FIG. 2. In the figure, numeral 100 denotes a reading section that reads a manuscript photoelectrically, converts it to a digital image signal and outputs it to the control section 101. This reading section includes a motor for transporting manuscripts, a CCD image sensor, etc. Next, the construction of this control section 101 will be explained. Numeral 110 denotes line memory in which image data of each line of image data is stored. During transmission of a manuscript or copying, one line of image data from the reading section 100 is stored. During the reception of image data, one line of received image data which has been decoded is stored. Stored data is output to the recording section 102, thus images are formed. Numeral 111 is an encoding/decoding section for decoding and converting coded image data received to image data. Numeral 112 denotes a buffer memory in which coded image data to be transmitted or received is stored. These sections of the control section 101 are controlled, for example, by a CPU 113 (microprocessor). The control section 101 includes a ROM 114 which stores control programs for the CPU 113 and various kinds of data, a RAM 115 in which various kinds of data are temporarily stored as a work area for the CPU 113, in addition to this CPU 113.

Numeral 102 denotes a recording section having a thermal line head, that performs image recording by a heat transfer recording method. The construction and the outline of the operation thereof will be described later.

Numeral 103 denotes an operation section containing various function instruction keys for starting transmission, and telephone number input keys. Numeral 103*a* denotes a switch for specifying the type of ink sheet 14 to be used. When the switch 103*a* is on, it indicates that multiprint ink sheets are loaded; when off, ordinary ink sheets are loaded. Numeral 104 is a display section for displaying various functions and status of apparatuses, which is usually disposed adjacent to the operation section 103. Numeral 105 denotes a power supply section for supplying electric power to the entire apparatus. Numeral 106 denotes a modem (modulator/-demodulator), 107 denotes a network control unit (NCU), and 108 denotes a telephone set.

The construction and the outline operation of the recording section 102 will be explained with reference to FIG. 3. Parts common to those used in FIG. 2 are indicated by the same reference numerals.

In FIG. 3, numeral 10 denotes a paper roll in which recording paper 11 is wound on a core 10*a* in roll form. This roll of paper 10 is rotatably housed in the apparatus so that the recording paper 11 can be supplied to a thermal head section 13 by the rotation of a platen roller 12 in the direction of the arrow. Numeral 10*b* denotes a roll paper load section in which the roll paper 10 is releasably loaded. The platen roller 12 transports the recording paper 11 in the direction of arrow b, so that an ink sheet 14 and recording paper 11 are pressed between the thermal head section 13 and a heating body 132. The recording paper 11 on which an image is recorded as the result of the heat generation by the thermal head section 13 is transported to ejection rollers 16 (16*a* and 16*b*) by the further rotation of the platen roller 12 and is cut off page by page by the engagement of a cutter 15 section (15*a* and 15*b*) when the recording of one page of an image has terminated.

Numeral 17 denotes an ink sheet supply roll around which an ink sheet 14 is wound, and 18 denotes an ink sheet take-up roll which is driven by a motor for transporting ink sheets to be described later and which takes up the ink sheet 14 in the direction of arrow a. The ink sheet supply roll 17 and the ink sheet take-up roll 18 are releasably mounted in the ink sheet loading section 70 in the apparatus main body. Numeral 19 denotes a sensor for detecting the amount of the remaining ink sheet 14 and the transport speed of the ink sheet 14. Numeral 20 denotes an ink sheet sensor for detecting the presence or absence of the ink sheet 14, 21 denotes a spring with which the thermal head section 13 is pressed against the platen roller 12 via the recording paper 11 and the ink sheet 14, and 22 denotes a recording paper sensor for detecting the presence or absence of the recording paper.

Next, the construction of the reading section 100 will be explained.

In FIG. 3, numeral 30 denotes a light source for illuminating a manuscript 32. Light reflected from the manuscript 32 is input to the CCD sensor 31 through an optical system (mirrors 50 and 51, and lens 52) and converted to an electrical signal. The manuscript 32 is transported in correspondence with the reading speed of the manuscript 32 by means of transport rollers 53, 54, 55 and 56 driven by a motor for transporting manuscripts (not shown). Numeral 57 denotes a manuscript holder. A plurality of manuscripts 32 placed in, this manuscript holder are separated into single sheets by the cooperative movement of a transport roller 54 and a press separation piece 58 and transported to the reading section 100.

Numeral 41 denotes a control board constituting the main portion of the control section 101. Various control signals are output to each section of the apparatus from this control board 41. Numeral 106 denotes a modem board unit, and 107 denotes an NCU board unit.

FIG. 4 shows the relationship between the transport mechanism for the ink sheet 14 and the recording paper 11 and the control section. In the figure, numeral 24 denotes, a motor which rotates the platen roller 12 to transport the recording paper 11 in the direction of arrow b opposite to the direction of arrow a. Numeral 25 denotes an ink sheet transporting motor for transporting the ink sheet 14 in the direction of arrow a by means of a capstan roller 71 and a pinch roller 72. Each of these motors is driven by means of driver circuits 48 and 49. Numerals 26 and 27 denote transmission gears for transmitting the rotation of the motor 24 for transporting recording paper, 73 and 74 denote transmission gears for transmitting the rotation of the motor 25 for transporting ink sheets, and 75 denotes a slide clutch unit.

In this embodiment by suitably setting the value of the reduction ratio $i_I$ of gears 73 and 74 and the value of the reduction ratio $i_P$ of gears 26 and 27, the number of multiprint operations n can be set.

At this point, by setting the ratio of the gear 74 to the gear 75 so that the length of the ink sheet 14 taken up by a take-up roll 18 by the rotation of a gear 75*a* becomes longer than the length of an ink sheet transported by the capstan roller 71, the ink sheet 14 transported by the capstan roller 71 can be reliably taken up by the take-up roll 18. The excess rotation which is the difference between the amount of the ink sheet 14 taken up by the take-up roll 18 and the amount of the ink sheet 14 supplied by the capstan roller 71 is absorbed by the clutch unit 75. As a result, variations in the transport speed (amount) of the ink sheet 14 caused by the variations in the amount of material taken up by the take-up roll 18 can be reduced.

The following explanation is out of sequence. By making the directions in which the recording paper 11 and the ink sheet 14 are transported opposite to each other, the direction (direction of arrow a) in which recording is made on the recording paper 11 coincides with the direction in which ink sheets are transported. When the transport speed $V_P$ of the recording paper 11 is expressed as $V_P = -n \cdot V_I$ (where $V_I$ is the transport speed of the ink sheet 14, and the "−" sign indicates that the recording paper 11 and the ink sheet 14 are transported in opposite directions), the relative speed $V_{PI}$ of the recording paper 11 and the ink sheet 14 seen from the thermal head section 13 is expressed by $$V_{PI}=V_P-V_I=(1-1/n)\cdot V_P.$$

It is understood from the above equation that the relative speed $V_P$ is greater than the relative speed $V_{PI}'=(1-1/n)\cdot V_P$ when the directions in which an ink sheet and recording paper are to be transported are made the same. This allows the force for separating the recording paper from the ink sheet 14 to be increased.

The details of the connections among the thermal head section 13, the motor for transporting recording paper 24, the motor for transporting ink sheets, and the control section 101 are shown in FIG. 1. Parts common to the other figures are given the same reference numerals as in the other figures.

The thermal head section 13 is a line head. This thermal head section 13 includes a shift register in which one line of serial recording data from the control section 101 and a shift clock 43 are entered, a latch circuit 131 for latching the data for the shift register 130 in response a latch signal 44, and a heat producing element 132 composed of heat producing resistors for one line. The heat producing element 132 is divided into m blocks denoted by 132-1 to 132-m (in this embodiment m is set "4") and is driven. Numeral 133 denotes a temperature sensor for detecting the temperature of the thermal head section 13, which is mounted on the thermal head section 13. The output signal 42 from this temperature sensor 133 is converted from analog to digital form in the control section 101 and input to the CPU 113. As a result, the CPU 113 detects the temperature of the thermal head section 13 in order to changes the pulse width of a strobe signal 47 in response to the temperature, or changes a driving voltage for the thermal head section 13 to change the energy applied to the thermal head section 13 in response to the characteristics of the ink sheet 14. Numeral 116 denotes a programmable timer, in which a counting time is set by the CPU 113, which begins to count time when an instruction to start the counting of time has been given. It operates so as to output an interrupt signal and a timeout signal at each specified time.

The types (characteristics) of the ink sheet 14 may be distinguished by detecting the switch 103*a* of operation section 103 and a mark printed on the ink sheet 14, or may be distinguished from marks attached, notches in, or a projection on a cartridge for an ink sheet.

Numeral 46 denotes a driving circuit for accepting a drive signal for the thermal head section 13 from the control section 101 and for outputting a strobe signal 47 used to drive the thermal head section 13 by each block. This driving circuit 46 can change a voltage output to a power supply line 46 for supplying a current to the heat producing element 132 of the thermal head 13 to change an energy applied to the thermal head 13. Numeral 36 denotes a driving circuit for causing the cutter 15 to be engaged and driven, which includes a motor for driving the cutter. Numeral 39 denotes a paper ejection motor for rotating the paper ejection roller 16. Numerals 35, 31, and 32 denote driver circuits for driving the paper ejection motor 39, the motor 24 for transporting recording paper, and the motor 25 for transporting ink sheets, respectively. These motors 39, 24, and 25 are in this embodiment stepping motors, however, they are not limited to stepping motors and, for example, may be DC motors.

Figure 8:
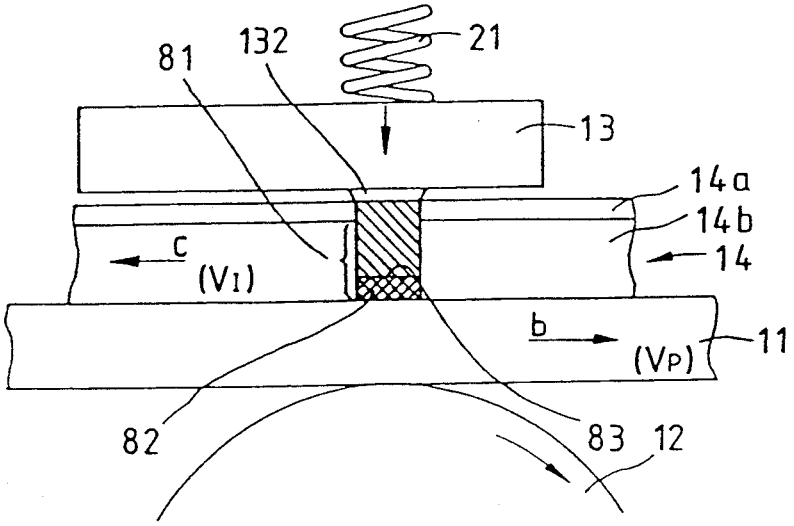
FIG. 8 is a view illustrating the printing principles in the embodiment.

FIG. 8 shows the state of image recording when the recording paper 11 is transported in the direction opposite to the direction in which the ink sheet 14 is transported, and the recording of images is performed.

As shown in the figure, the recording paper 11 and the ink sheet 14 are positioned between the platen roller 12 and the thermal head 13. The thermal head 13 is pressed against the platen roller 12 with a predetermined pressure by means of a spring 21. At this point, the recording paper 11 is transported in the direction of arrow b at a speed $V_P$ by the rotation of the platen roller 12. Meanwhile, the ink sheet 14 is transported in the direction of arrow c at a speed $V_I$ by the rotation of the reel motor 25.

When one element of the heat producing element 132 of the thermal head 13 produces heat, the portion of the ink sheet 14 indicated by the shaded portion 81 is heated. In the figure, numeral 14*a* denotes the base film of the ink sheet 14 hand 14*b* denotes an ink layer of the ink sheet 14. The ink of the ink layer 81 heated by the electricity supplied to one element of the heat producing element 132 so that it melts and the portion indicated by numeral 82 is transferred to the recording paper 11. This ink layer portion 82 transferred is equivalent to almost 1/n of the entire ink layer 81. It is required at this transferring time that a shearing force with respect to the ink be generated at the interface line 83 of the ink layer 14*b* so that only the portion of the ink layer indicated by 82 is transferred to the recording paper 11. However, this shearing force differs varies depending upon the temperature of the ink layer. In other words, the higher the temperature of the ink layer, the smaller the shearing force required; conversely, with the lower the temperature, a greater force is required.

With the construction of the embodiment explained above, the heat producing element 132 of the thermal head 13 is made to produce heat as required, thus a shearing force between an ink sheet and recording paper is kept at a satisfactory state.

Data received via the NCU 107 is in turn decoded by the encoding/decoding section 111. One line of data to be printed is stored and is latched by a latch circuit of the reading section 102. However, the time required to generate one line of image data by a decoding operation differs depending on the status of the decoding data. That, is, the time from when a certain line is recorded until image data for the next line is stored varies. As a result, the rate at in which ink sheets cool and solidify may be fluctuate. This embodiment is meant to rectify this situation.

The procedure in this embodiment for achieving this will be explained with reference to the flowcharts of FIGS. 5A to 5D. The operation procedures of these flowcharts are stored as programs in the ROM 114 of the control section 101.

It is presupposed in this operation that one line of image data to be recorded is stored in the line memory 110. The operation is started when a recording operation is ready to start the central section 101 recognizes that the multi-ink sheet 14 is loaded from the switch 103*a*. The recording operation in the embodiment requires that to record one line, each block (four blocks) of the heat producing element 132 is scanned two times. The reason for this is that if the two scannings are reduced to one scanning, it follows that the heat producing element 132 is heated more than necessary.

The following aspects of the invention will be explained hereinunder. Data is stored in a block counter for indicating which block of the heat producing resistor is to be (or is being) supplied with electricity, data for indicating the number of the scan shown by the division number counter, and data of the heat production flag for indicating whether or not it is producing heat. All of these are secured at predetermined address positions in the RAM 115 of the control section 101.

In step S1, one line of record data is output to the shift register 130 serially. When the transferring of the one line of record data is completed, a latch signal 44 is output in step S2 to make the latch circuit 131 hold one line of record data. Next, in step S3, the motor 25 for transporting ink sheets is driven to transport the ink sheet 14. In step S4, line of the recording paper 11 is transported. The length of this one line is set at approximately 1/15.4 mm in the facsimile apparatus. The amount of transportation of the recording paper 11 and the ink sheet 14 can be set by changing the number of exciting pulses of the motor 24 for transporting recording paper and the motor 25 for transporting the ink sheets, respectively. For example, it is assumed that the motor for transporting recording paper and the motor 25 for transporting ink sheets are driven by one/two phase excitation and the recording paper 11 is transported one line by one excitation and is excited 20 times in order to transport the ink sheet 14 the same length. At this time, where the number of times n of multiprint operations is "5", and when the recording paper 11 has transported one line, the ink sheet 14 is transported $1/(15.4\times5)$ mm after four excitations.

When the transport of the recording paper 11 and the ink sheet is terminated in this manner, the process proceeds to step S5 where "2" is stored in the division number counter as the initial value. The process proceeds to step S6 where "1" is stored in the block counter. Then, the process proceeds to step S7 where electricity is supplied (a strobe signal is output to a corresponding block) to the block of the heat producing element 132 specified by the value of the block counter, and in step S8, 0.3 ms is set in the timer 116 as a one-time electrical conductance time period. In step S9, it is determined whether or not this electrical conductance time has elapsed.

When it is judged to be during an electrically conducting state, the process proceeds to step S10 where the presence or absence of data from the next line to be transferred to the thermal head 13 is ascertained. Where data is present, an operation for transferring the data to the thermal head 13 is performed (step S11). At this time, an operation for decoding received data is also performed.

In this way, in step S9, the operation for transferring data from the next line is repeated until it is judged that the electrical conductance time period has elapsed. When the supply of electricity to one block of the heat producing resistor, 132 is terminated, the process proceeds to step S12 where it is determined whether or not the value of the block counter 12 has reached "4." If it has not, the value is incremented by 1 in step S13, and a process for supplying electricity to the next block is performed. When electricity is supplied to four blocks in this way, the judgment of step S12 becomes "YES", and the process proceeds to step S14 where it is determined whether or not the value of the division number counter is "1". When the value is not "1", the process proceeds to step S15 where the division number counter is decremented by 1, and the processes of step S6 and those steps that follow are performed. Since the value of the block counter is set at "1" in step S6, eventually, each block of the heat producing element 132 is supplied with electricity twice for the recording of one line.

Figure 6:
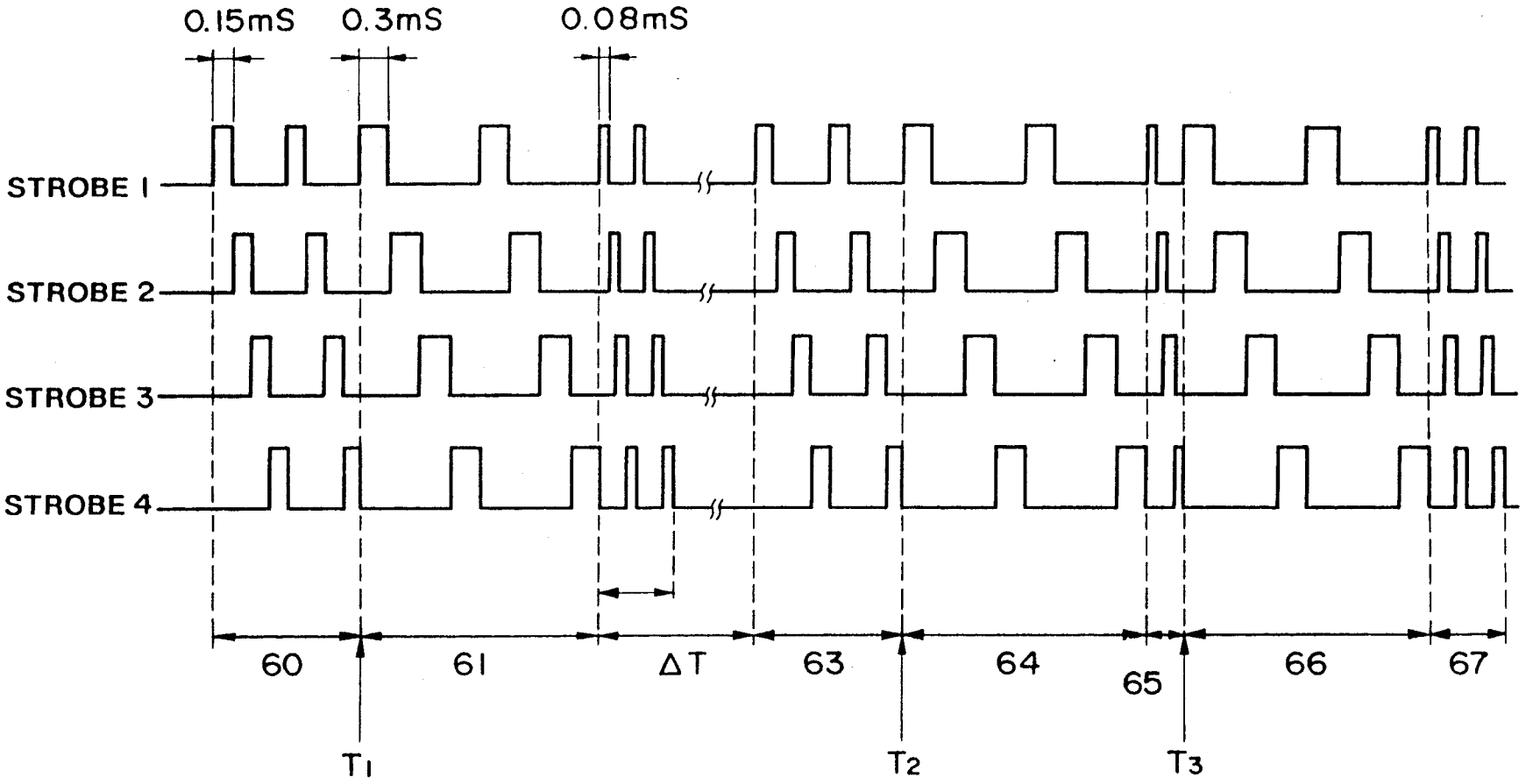
FIG. 6 is a view illustrating electrical conductance timing for each block of a thermal head in the embodiment.

As shown in the timing chart in FIG. 6, the recording operation by the above-mentioned two scannings corresponds to periods 61, 64 or 66. The pulse width of a strobe signal corresponding to each block is 0.3 and is set in the timer 116.

When it is determined that the division number counter has, reached "1", in other words, when each block has been supplied with electricity for two 0.3 ms time periods, the process proceeds to step S16 where 20 ms is set in the timer 116, and in step S17 the heat production flag is set to "0".

After this, in step S18, it is determined whether or not recording of one page has been terminated. In the case of yes, process proceeds to step S43 and those steps that follow; when it is no, the process proceeds to step S19.

An explanation will now be given assuming that the recording of one page has not been completed. In this case, the process proceeds to step S19 where it is determined whether or not the transfer of image data for the next line has been, completed. When it is judged that the transfer is complete, the process proceeds to step S20 where it is determined whether or not the set time (20 ms) has elapsed.

When the transfer of data for the next line has been completed and it is judged that 20 ms has not elapsed after the last line was recorded, it is judged that the heat producing element 132, particularly the ink sheet, is at a sufficient temperature. Therefore the process returns to step S2 in order to record the next line.

When the transfer of image data for the next line has not been completed during last line recording (period 61, etc.), the process proceeds from step S19 to step S21.

In step S21, an operation for transferring data for the next line (which operation includes a receiving and decoding operation) is performed. The operation for maintaining the temperature of the heat producing element 132 is performed until the heat production flag is judged to be "2" in step S22. Basically, the operation is the same as the above-mentioned recording of one line. That is, "2" is set in the division number counter and the block counter is set to "1". The time period during which electricity is supplied to each block is set at 0.08 ms. Electricity is supplied to the heat producing resistor to maintain its temperature for the set period until it is judged that the transfer of data for the next line is completed.

Figure 5A:
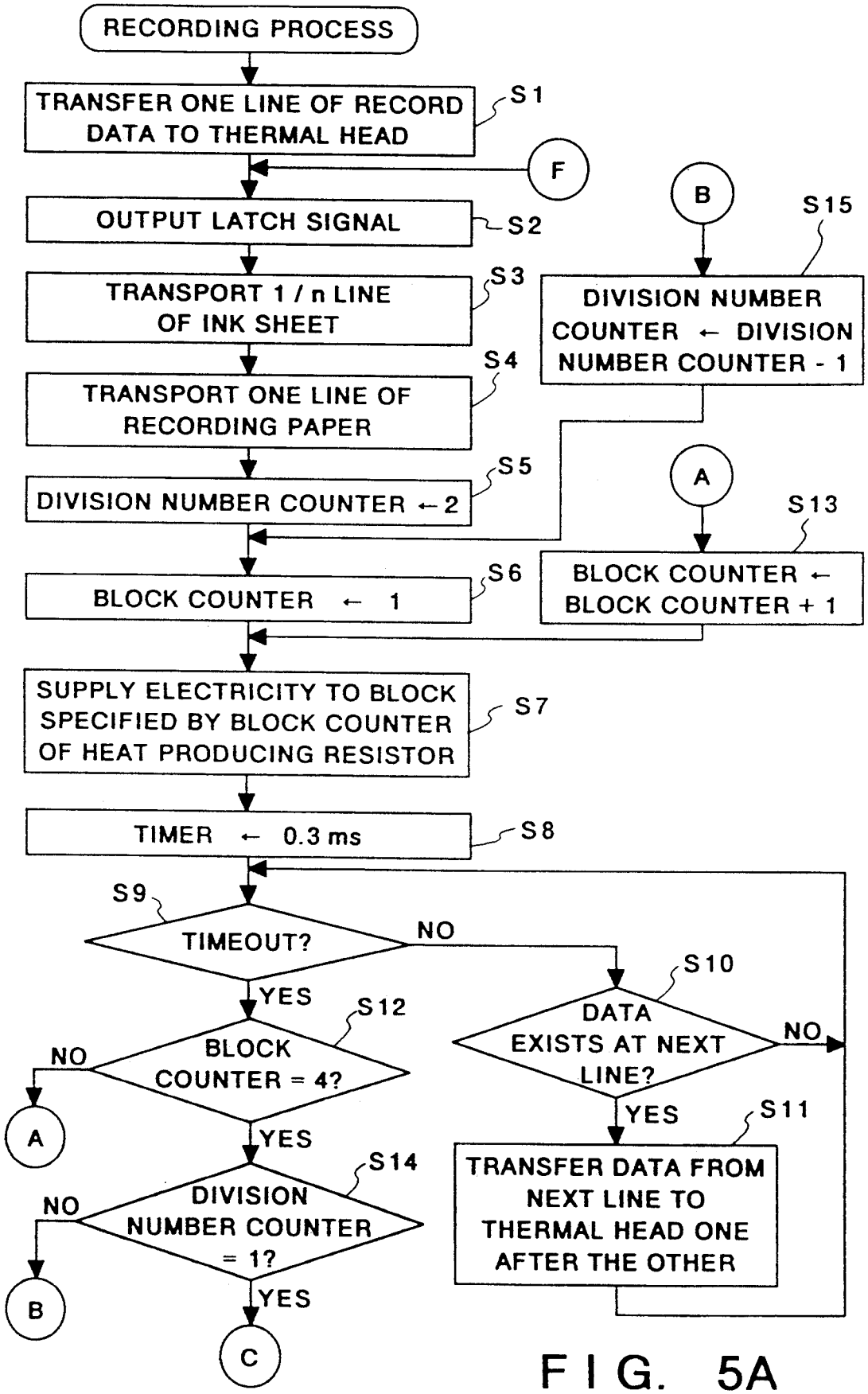
FIGS. 5A to 5D are flowcharts showing recording processes in the embodiment.
Figure 5B:
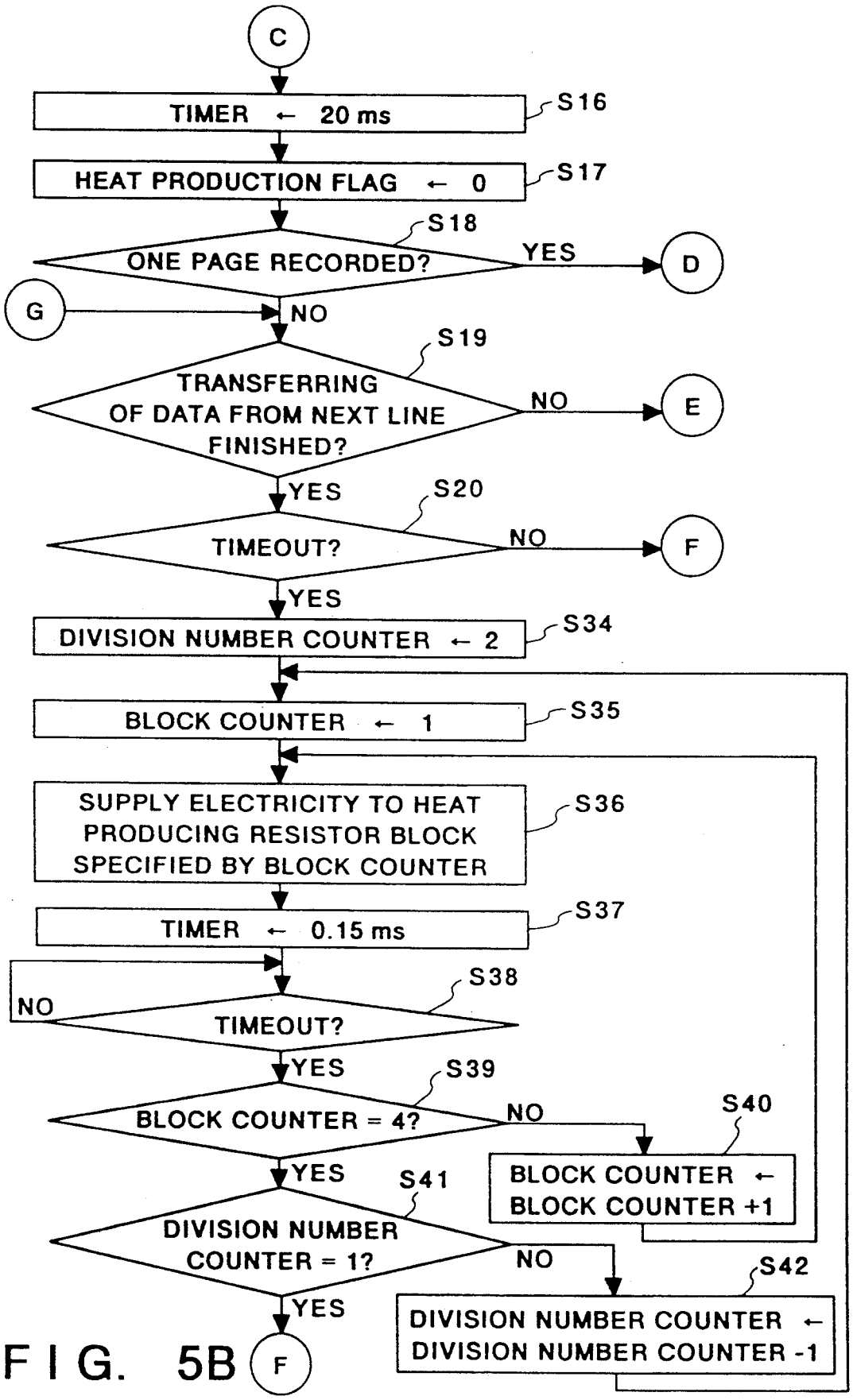
Figure 5C:
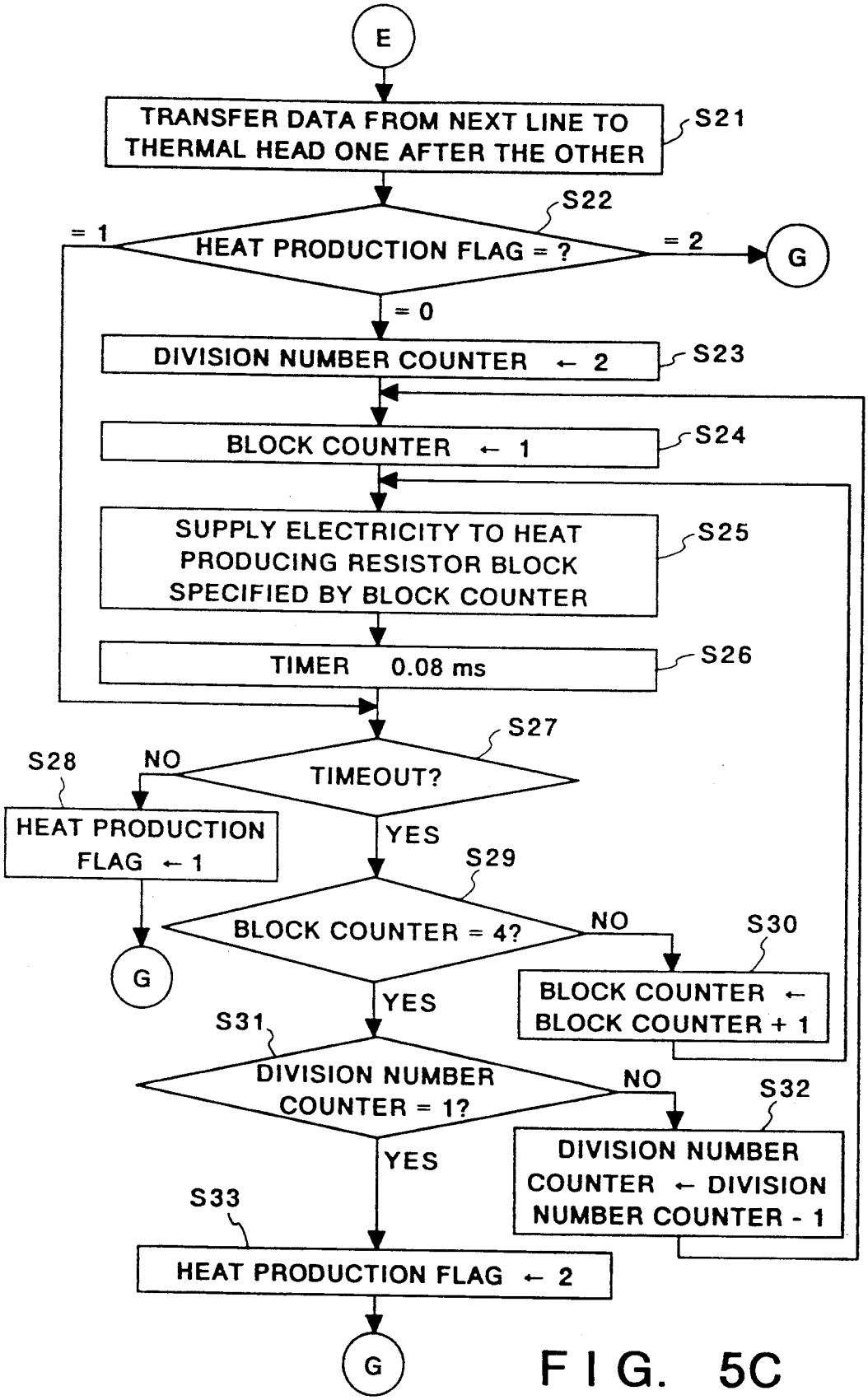
Figure 5D:
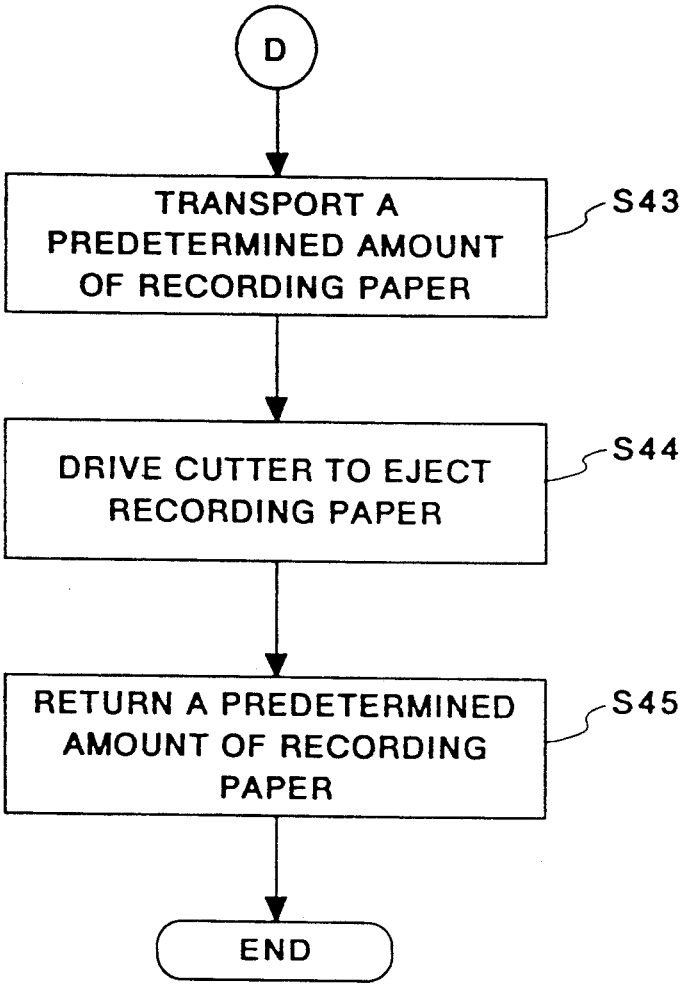

The outline of the data transfer operation and the temperature maintenance operation in FIG. 5C is almost the same as in FIG. 5A, so the explanation thereof is omitted. Because the heat production flag is "0" at the initial stage of the temperature maintenance operation, the setting of parameters is performed (step S23, etc.). The parameter is set to "1" so that the operation of setting this parameter will not be performed during an actual temperature maintenance operation. When two scans for the constant temperature maintenance are completed, the heat production flag is set to "2". Even in this stage, when there are data which have not been transferred, the temperature maintenance operation is stopped and the process is devoted to the operation of transferring data. That is, since the heat production flag has become "2", the process loops the steps S19→S21→S22→S19.

As described above, each strobe signal lasting 0.08 ms is output to the heat producing resistor even while data from the next line is being transferred, thereby preventing the temperature from dropping down. The temperature maintenance period during the transfer of data for the next line corresponds to periods 62, 65, and 67 in FIG. 6. In particular, period 65 indicates the case where the transfer of data for the next line is terminated during one scan.

When the transfer of data for the next line is completed in any way, the process proceeds from step S19 to step S20, in which step it is determined whether or not 20 ms has elapsed from when the timer was set in step S16. When the time has not yet elapsed, it is judged whether the ink has proper temperature, and the process returns to step S2 in order to record the next line.

On the other hand, when this period has elapsed, it may be judged that the ink has cooled considerably. That is, if recording paper and the ink sheet are transported as they are in order to record the next line, they will become stuck to each other. For this reason, in step S34 and those that follow, an ink melting operation is performed before the recording of the next line.

More concretely, each block of the heat producing element 132 is scanned twice. That is, an operation almost the same as the actual recording operation explained earlier is performed. However, the time period during which electricity is supplied to each block of the recording head is 0.15 ms. This period corresponds to periods 60 and 63 shown in FIG. 6. The reason why it is divided and heated is that it is intended to reduce the temperature difference error among the blocks in this embodiment. That is, if each block is not divided, when the printing of the last block is terminated, the first block cools. The amount of energy to be applied is the amount necessary for achieving the object according to the type of the ink and may be set at any amount. To explain the operation procedure, first, the division number counter is set to "2" in step S34 and the block counter is set to "1" in step S35. Hereafter, in step S36, electricity is supplied to the block of the heat producing element 132 specified by the block counter for 0.15 ms (set in step S37). When it is judged that the block counter has become "4" in step S39 and the division number counter has become "1" in step S41, the process returns to step S2 where the operation for recording the next line is performed. The update of the block counter is performed in step S40, and the update of the division number counter is performed in step S42.

When each line is recorded in this manner and it is judged that recording of one page is terminated the process proceeds from step S18 to step S43 where a predetermined amount of the recording paper 11 is transported toward the paper ejection rollers 16*a* and 16*b*. In step S44, the cutters 15*a* and 15*b* are driven to be engaged with each other and the recording paper 11 is cut off page by page. Next, the process proceeds to step S45 where the operation for returning the recording paper 11 a distance equivalent to the space between the thermal head 13 and the cutter 15 by driving the motor 24 for transporting recording paper to rotate reversely is performed.

In FIG. 6, the excitation phase of the motor 24 is switched in timings $T_1$, $T_2$, and $T_3$, and the recording paper is transported by one line.

Figure 7:
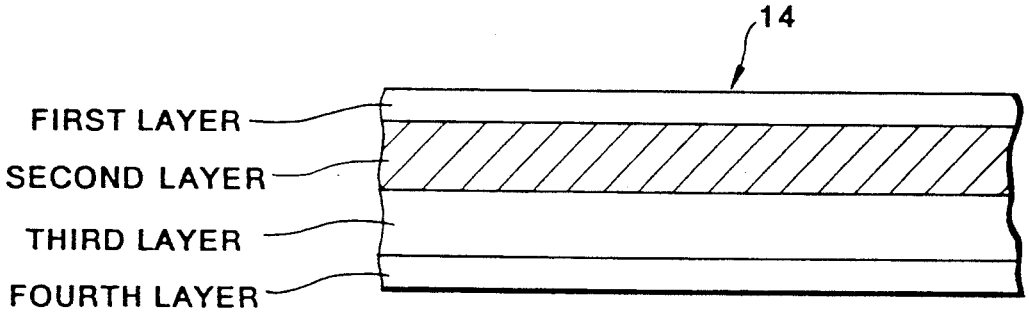
FIG. 7 is a view showing the structure of an ink sheet in the embodiment.

FIG. 7 is a cross sectional view of an ink sheet used for the multiprint recording operation in this embodiment, in which the ink sheet is formed with four layers.

First, the second layer is a base film which serves as the support body for the ink sheet 14. In the case of the multiprint recording operation, since thermal energy is applied to the very same place many times, use of an aromatic polyamide film or a capacitor paper having high resistance to heat is advantageous. However, a conventional polyester film also withstands use. As regards the thickness of these films, it is desirable that these films be as thin as possible from the viewpoint of the role of these films as a medium, and a thickness of 3 to 8 μm is preferable in view of the strength of films of such thickness.

The third layer is an ink layer which contains ink in an amount which permits n times of transfer to the recording paper (recording sheet). This ink includes, as main ingredients, resin like EVA as a bonding agent, carbon black and nigrosine dye for coloring, carnauba wax and paraffin wax as a binding material, etc. These ingredients are mixed so as to withstand n times of use at the very same place. The amount of this application should preferably be 4 to 8 $g/m^2$. However, the sensitivity or concentration differs depending on the amount of application, and those ingredients may be chosen at will.

The fourth layer is a top coating layer for preventing the ink of the third layer from being transferred by pressure to the recording paper where printing will not be performed. The fourth layer consists of wax and the like. Thus, the portion which is transferred by pressure is only the transparent fourth layer, and the ground of the recording paper can be prevented from being stained.

The first layer is a heat resisting coat layer for protecting the base film of the second layer against the heat from the thermal head 13. This heat resisting coat layer is suited to a multiprint recording operation in which there is a probability that a thermal energy for n lines is applied to the very same place (when black data continues). Whether or not the layer is used is optional. The heat resisting coat layer is effective for a base film having a relatively low resistance to heat like a polyester film.

The structure of the ink sheet 14 is not limited to this embodiment. For example, it may be formed with one composed of a porous ink holding layer in which ink is contained provided on a base layer or one side of a base layer, or one with a heat resisting ink layer having a hyperfine porous network structure on a base film, in which ink is contained in the ink layer. The material of the base film may be a film or paper composed of, for instance, polyamide, polyethelene, polyester, polyvinyl chloride, triacetyl cellulose, nylon, or the like. In addition, the heat resisting coat layer is not necessarily required, but the material may be, for instance silicon resin, epoxy resin, fluororesin or the ethylcellulose, or the like.

As an example of an ink sheet having a heat sublimable ink, an ink sheet with a coloring material containing spacer particles and dye formed by guanamine-based resin and fluororesin disposed on the base material formed by polyethelene terephthalate, polyethelen haphthalate, aromatic polyamide film, or the like can be cited.

The method of heating in a heat transfer printer is not limited to the thermal head method in which the above-mentioned thermal head is used. For example, an electrical conductance method or a laser transfer method may be used.

In this embodiment, an example in which a thermal line head is used is explained. However, the heat transfer printer is not limited to this embodiment and may be the so-called serial type heat transfer printer. In this embodiment, the case of the multiprint recording operation is explained. However, it is not limited to this multiprint operation. Needless to say, the present invention can be used in an ordinary heat transfer recording by using one-time sheets.

In the above-mentioned embodiment, the case in which a heat transfer printer is used in a facsimile apparatus is explained. The present invention is not limited to this embodiment. For example, the heat transfer recording apparatus of the present invention can be used in word processors, typewriters, copying apparatuses, or the like.

The recording medium is not limited to recording paper. As the recording medium, all materials to which ink can be transferred, for instance, fabric or plastic sheets, can be cited. The ink sheet is not limited to the roll structure shown in the embodiment, and may be a so-called ink sheet cassette type in which ink sheets which are releasably loaded from the main body of a recording apparatus are contained in a housing, and this housing and all is mounted or demounted to the main body of the recording apparatus.

In the above-mentioned embodiments, the division number for heat production for recording, constant temperature maintenance, and for melting ink is all set to "2". Of course, a setting other than this "2" does not pose any problem. In addition, it does not matter if the time period of electrical conductance in each heat production is changed to any other time period.

The heat production energy for melting solidified ink may be controlled according to the elapsed time from when the recording of, a line immediately before is terminated. That is, when the elapsed time is long, an energy to be applied is increased. This increase may be performed by controlling the electrical conductance time in an analog form, or by changing the number of scans.

In this embodiment, the density of sub-scanning lines is set at 15.4 (lines)/mm. It may be set at 7.7 l/mm or 3.85 l/mm. In such, a case, heat production for recording is performed twice in the case of 7.7 l/mm and four times in the case of 3.85 l/mm. Heat production for melting solidified ink and constant temperature maintenance is performed before and after that heat production as required.

As has been explained above, according to this embodiment, depending on the preparation of image data to be recorded, a thermal head is made to produce heat to melt solidified ink or to maintain its temperature. Therefore, factors that cause the density to be nonuniform or ink recording paper to stick to each other are eliminated and high-quality images can be obtained.

It is particularly effective to use the heat transfer recording mechanism of this embodiment in a facsimile apparatus in which the time required to obtain one line of image data varies.

As many apparently widely different embodiments of the present invention can be made without departing from the spirit and scope thereof, it is to be understood that this invention is not limited to the specific embodiments thereof except as defined in the appended claims.

What is claimed is:

1. A heat transfer recording apparatus which records images on a recording medium by transferring an ink contained in an ink sheet to said recording medium, comprising:

ink sheet transport means for transporting said ink sheet;

recording medium transport means for transporting said recording medium;

recording means for recording images on said recording medium by acting on the ink sheet;

judging means for judging whether or not an image data to be recorded next is ready for recording;

first heating control means for controlling heating of said recording means when the judging means has judged that a next image to be recorded next is being prepared;

second heating control means for controlling heating of said recording means immediately before the image data to be recorded next is recorded when more than a predetermined time is required before the next image to be recorded next is produced; and control means for controlling driving of said ink sheet transport means and driving said recording medium transport means so as to transport said ink sheet and said recording medium to record the next image when said judging means has judged that the preparation of the image data to be recorded next is completed and said first or said second heating control means has heated said recording means.

2. A heat transfer recording apparatus according to claim 1, wherein said first and said second heating control means heat said recording means so that a heat producing energy becomes lower than during ordinary recording.

3. A heat transfer recording apparatus according to claim 1, wherein said first and said second heating control means heat said recording means on a basis of the image data recorded immediately before.

4. A heat transfer recording apparatus that records images by transferring an ink from an ink sheet to a recording medium based on one line of image data being prepared one after the other, comprising:

ink sheet transport means for transporting the ink sheet;

recording medium transport means for transporting said recording medium;

recording means having heat producing resistor elements needed for the recording of one line, for recording images by heating said heat producing resistor elements which correspond to said image data;

judging means for judging whether or not image data from a next line having an image to be recorded is prepared after one line of image is recorded by the recording means;

first heating control means for controlling heating of the recording means when the judgment means has judged that the image from the next line to be recorded is being prepared;

second heating control means for controlling heating of the recording means immediately before recording based on the image data from the next line to be recorded is performed when more than a predetermined time is required before the image data from the next line to be recorded is prepared; and control means for controlling driving of said ink sheet transport means and driving of said recording medium transport means so as to transport said ink sheet and said recording medium in order to record the next image when said judging means has judged that preparation of the image data to be recorded next is completed and said first or said second heating control means has heated said recording means.

5. A heat transfer recording apparatus according to claim 4, wherein said first and second heating control means heat said recording means so that a heat producing energy becomes lower than during ordinary recording.

6. A heat transfer recording apparatus according to claim 4, wherein said first and second heating control means heat said recording means based on the image data recorded immediately before.

7. A heat transfer recording apparatus according to claim 4, wherein a predetermined heat producing energy is divided and said recording means is heated at one recording time.

8. A heat transfer recording apparatus according to claim 4, wherein said ink sheet is a multiprint ink sheet and said control means controls said recording medium transport means so as to transport one line of said recording medium and transport 1/n line (n: integer of 1 or more) of said ink sheet.

9. A heat transfer recording apparatus according to claim 4, wherein a transport direction of said ink sheet transport means is opposite to a transport direction of said recording medium transport means.

10. A heat transfer recording apparatus which records images on a recording medium by transferring an ink contained in an ink sheet to said recording medium, comprising:

ink sheet feeding means for feeding said ink sheet;

recording medium feeding means for feeding said recording medium;

recording means for recording images on said recording medium by acting on said ink sheet, said recording means including a plurality of heat producing elements, each of said plural heat producing elements being driven selectively; and control means for controlling driving of said plural heat producing elements after an object image recording has been finished and before a next image recording is started, wherein said control means drives said plural heat producing elements with a first energy and then drives said plural heat producing elements with a second energy different from said first energy after the object image recording has been finished and before the next image recording is started.

11. A heat transfer recording apparatus according to claim 10, wherein said first energy is less than said second energy.

12. A heat transfer recording apparatus which records images on a recording medium by transferring an ink contained in an ink sheet to said recording medium, comprising:

ink sheet feeding means for feeding said ink sheet;

recording medium feeding means for feeding said recording medium;

recording means for recording images on said recording medium by acting on said ink sheet, said recording means including a plurality of heat producing elements, each of said plural heat producing elements being driven selectively; and control means for controlling driving of said plural heat producing elements after an object image recording has been finished and before a next image recording is started, wherein said control means drives said plural heat producing elements with a first energy and then drives said plural heat producing elements with a second energy different from said first energy after the object image recording has been finished and before the next image recording is started, and wherein said control means drives said plural heat producing elements with said first energy until a predetermined time as passed since the object image recording has been finished and before the next image recording is started, and drives said plural heat producing elements with said second energy after said predetermined time has passed.

13. A heat transfer recording apparatus which records images on a recording medium by transferring an ink contained in an ink sheet to said recording medium, comprising:

ink sheet feeding means for feeding said ink sheet;

recording medium feeding means for feeding said recording medium;

recording means for recording images on said recording medium by acting on said ink sheet, said recording means including a plurality of heat producing elements, each of said plural heat producing elements being driven selectively; and control means for controlling driving of said plural heat producing elements after an object image recording has been finished and before a next image recording is started, wherein said control means drives said plural heat producing elements with a first energy and then drives said plural heat producing elements with a second energy different from said first energy after the object image recording has been finished and before the next image recording is started, and wherein said control means refrains from driving said plural heat producing elements with said second energy if the next image recording by said recording means is possible and a predetermined time has not yet passed.

14. A heat transfer recording apparatus according to claims 10, 12 or 13, wherein said recording means further comprises a plurality of heat producing elements for an amount of one line, and said object image and said next image are each images of one line.

15. A heat transfer recording apparatus according to claim 14 wherein said recording medium feeding means feeds said recording medium with a first amount of feeding every time that the image recording for one line is performed and said ink sheet feeding means feeds said ink sheet with a second amount of feeding every time that the image recording for one line is performed.

16. A heat transfer recording apparatus according to claim 15, wherein said ink sheet is a multiprint ink sheet and said second amount of feeding is less than said first amount of feeding.

17. A heat transfer apparatus according to claim 15, wherein a feeding direction of said recording medium and a feeding direction of said ink sheet are opposite to each other.

18. The heat transfer apparatus according to claim 16, wherein a feeding direction of said recording medium and a feeding direction of said ink sheet are opposite to each other.

19. A heat transfer recording apparatus according to claims 10, 12, or 13, wherein said first and said second energy are less than the energy supplied to said heat producing elements when the image recording is performed.

* * * * *

UNITED STATES PATENT AND TRADEMARK OFFICE

CERTIFICATE OF CORRECTION

PATENT NO. : 5,177,499

DATED : January 5, 1993

INVENTOR(S) : TAKEHIRO YOSHIDA, ET AL.

It is certified that error appears in the above-identified patent and that said Letters Patent is hereby corrected as shown below:

COLUMN 5

Line 51, "the" (first occurrence) should be deleted.
Line 52, "16" should be deleted.
Line 53, "(16a and 16b)" should read --16a and 16b--.

COLUMN 6

Line 17, "in," should read --in--.
Line 30, "denotes," should read --denotes--.

COLUMN 7

Line 29, "set" should be deleted.
Line 36, "changes" should read --change--.
Line 38, "changes" should read --to change--.

COLUMN 8

Line 21, "hand" should read --and--.
Line 32, "differs" should be deleted.
Line 36, "the" (first occurrence) should be deleted.
Line 51, "in" should be deleted.
Line 52, "be" should be deleted.
Line 63, "start the central" should read --start and the control--.

COLUMN 9

Line 18, "sheet 14." should read --sheet 14 by 1/n of a line.-- and "S4, line" should read --S4, one line--.

UNITED STATES PATENT AND TRADEMARK OFFICE

CERTIFICATE OF CORRECTION

PATENT NO. : 5,177,499

DATED : January 5, 1993

INVENTOR(S) : TAKEHIRO YOSHIDA, ET AL.

It is certified that error appears in the above-identified patent and that said Letters Patent is hereby corrected as shown below:

COLUMN 9 (con't)

Line 19, "one" should be deleted.
Line 23, "transporting" should read --transporting the--.

COLUMN 10

Line 15, "has," should read --has--.
Line 22, "process" should read --the process--.
Line 28, "been," should read --been--.

COLUMN 11

Line 18, "proper" should read --the proper--.
Line 40, "amount. To" should read --amount. ¶ To--.
Line 54, "terminated" should read --terminated,--.

COLUMN 12

Line 58, "or the" should be deleted.
Line 64, "polyethelen" should read --polyethelene--.

COLUMN 13

Line 39, "of," should read --of--.
Line 58, "ink recording" should read --ink and recording--.

COLUMN 14

Line 49, "the" should be deleted.

UNITED STATES PATENT AND TRADEMARK OFFICE

CERTIFICATE OF CORRECTION

PATENT NO. : 5,177,499

DATED : January 5, 1993

INVENTOR(S) : TAKEHIRO YOSHIDA, ET AL.

It is certified that error appears in the above-identified patent and that said Letters Patent is hereby corrected as shown below:

COLUMN 16

Line 10, "as" should read --has--.
Line 46, "claim 14" should read --claim 14,--.
Line 64, "claims 10, 12, or 13," should read --claims 10, 11, 12, or 13,--.

Signed and Sealed this

Third Day of May, 1994

Bruce Lehman

*Attest:*

BRUCE LEHMAN

*Attesting Officer*

*Commissioner of Patents and Trademarks*